United States Patent [19]

Gillham

[11] 4,439,808

[45] Mar. 27, 1984

[54] ELECTROMAGNETIC LOCK

[75] Inventor: Peter J. Gillham, Frittenden, England

[73] Assignee: BSG (Security) Limited, London, England

[21] Appl. No.: 287,657

[22] Filed: Jul. 28, 1981

[30] Foreign Application Priority Data

Jul. 28, 1980 [GB] United Kingdom ..... 8024626
Jul. 28, 1980 [GB] United Kingdom ..... 8024627

[51] Int. Cl.[3] ..... H01H 47/00

[52] U.S. Cl. ..... 361/144; 361/171; 292/144

[58] Field of Search ..... 361/171, 172, 179, 143-144; 292/144, 201

[56] References Cited

U.S. PATENT DOCUMENTS

| | | | |
|---|---|---|---|
| 1,958,940 | 5/1934 | Cavanaugh et al. | 292/144 |
| 2,673,108 | 3/1954 | Roller | 292/144 |
| 2,727,772 | 12/1955 | Hamilton | 292/144 |
| 3,751,088 | 8/1973 | Schlage et al. | 292/201 |
| 3,851,314 | 11/1974 | Hedin | 361/172 X |
| 3,859,571 | 1/1975 | Strobl | 361/144 |
| 4,100,810 | 7/1978 | Sima, Jr. et al. | 361/171 X |
| 4,148,092 | 4/1979 | Martin | 361/172 |

FOREIGN PATENT DOCUMENTS

| | | |
|---|---|---|
| 252872 | 6/1926 | United Kingdom . |
| 265396 | 2/1927 | United Kingdom . |
| 278523 | 10/1927 | United Kingdom . |

*Primary Examiner*—Reinhard J. Eisenzopf
*Attorney, Agent, or Firm*—Sughrue, Mion, Zinn, Macpeak and Seas

[57] ABSTRACT

An electromagnetic lock for, for example, a door comprising an electromagnet attached to the frame and a magnetizable member attached to the door the magnetizable member being attracted to the electromagnet when the door is in its closed or otherwise locked position, shoulders being provided on or adjacent the electromagnet and magnetizable member whereby if the door is forced to overcome the electromagnetic attraction the shoulders engage to prevent unauthorized unlocking of the door.

9 Claims, 19 Drawing Figures

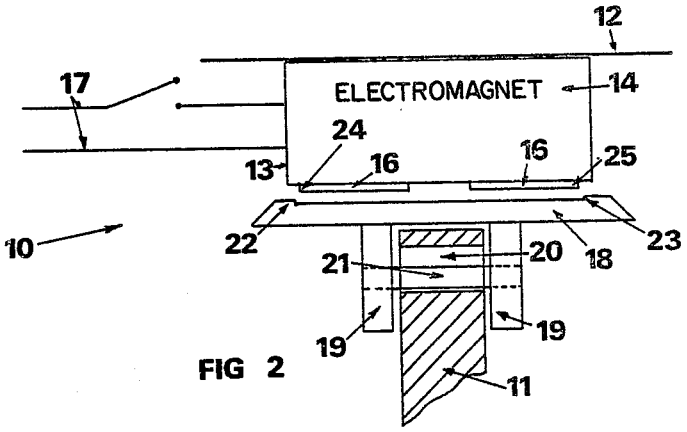
FIG 2
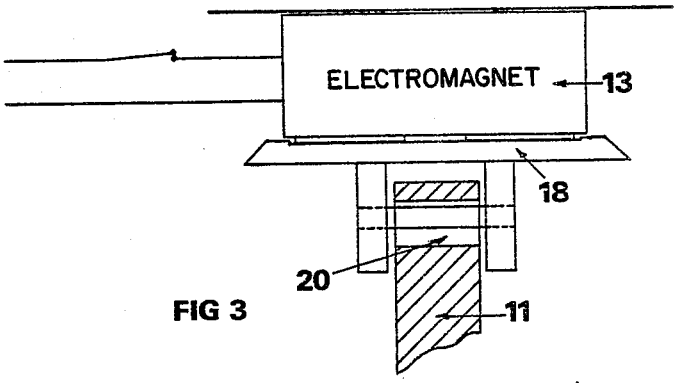
FIG 3
PRINCIPLE OF OPERATION
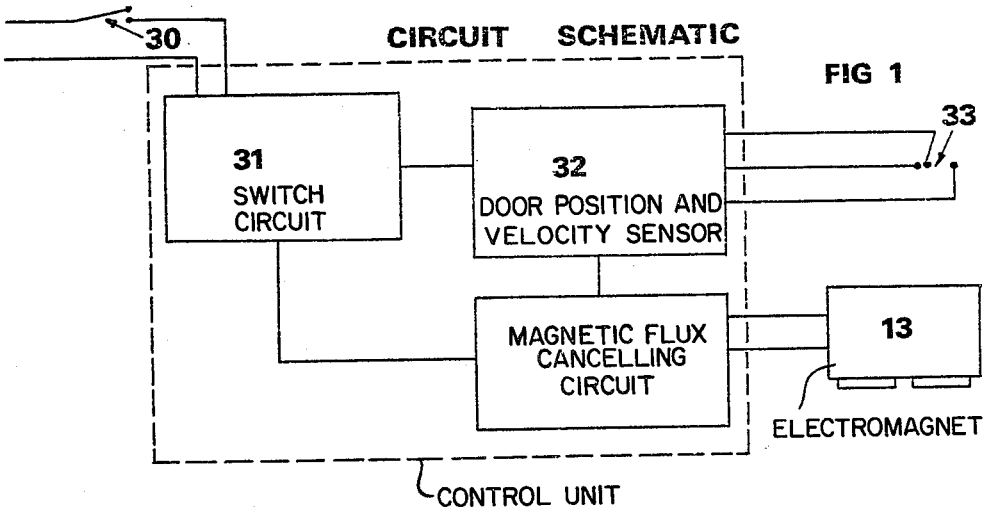

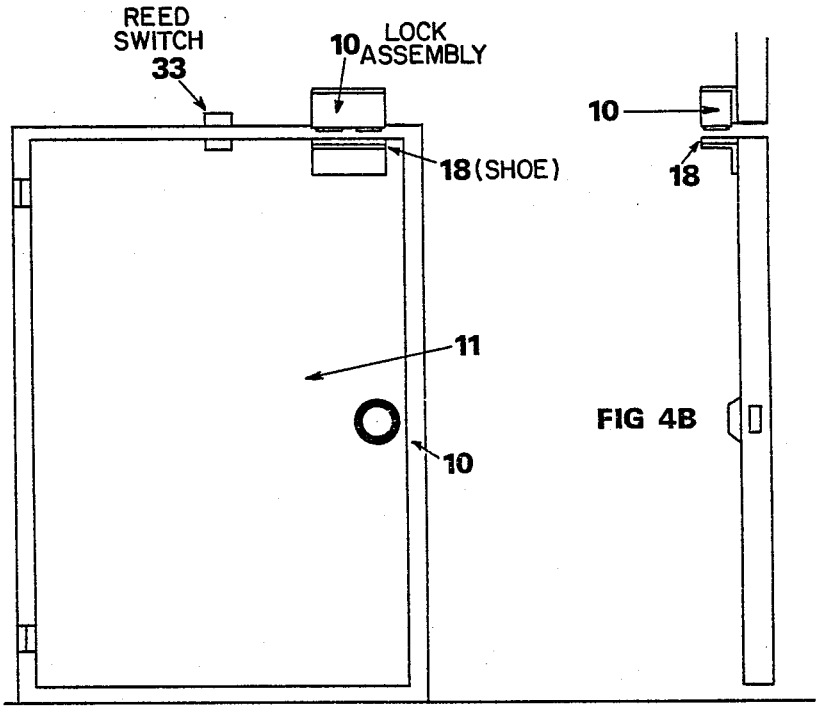
FIG 4A
FIG 4B
FIG 4D
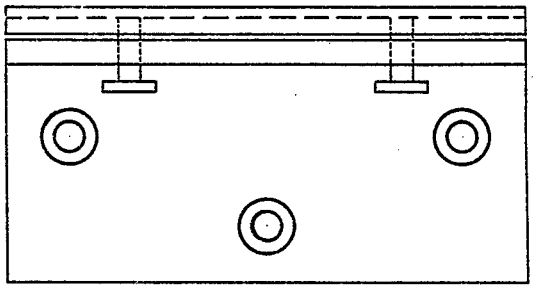
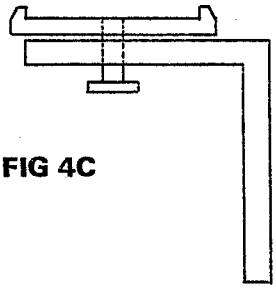
FIG 4C

116

135
134
121
114
131B
131
131A
133
10
143
130
122
+
120
139
128
129
131C
136
142
125
124
12/18V D.C.
113
117
137
132B
132A
141
138
126
127
132C
132
144
−
123

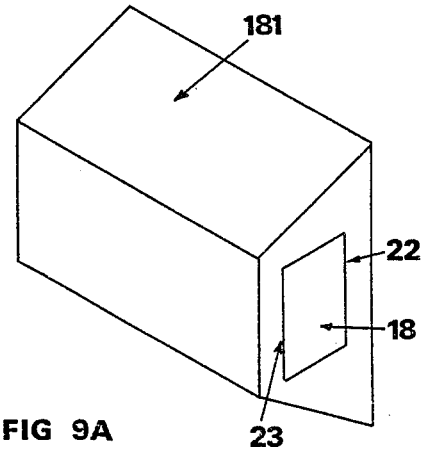
FIG 9A
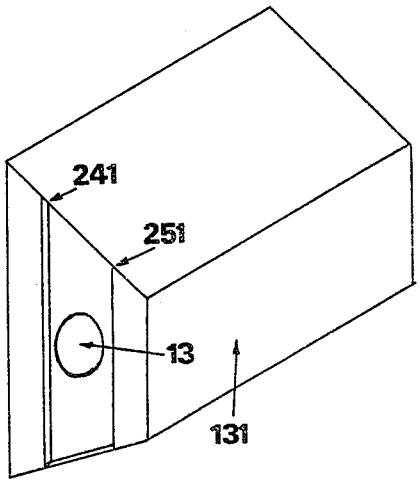
FIG 9B
FIG 10A
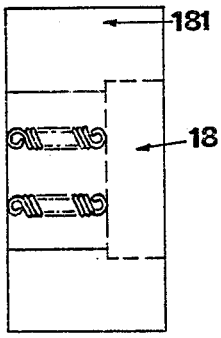
FIG 10B
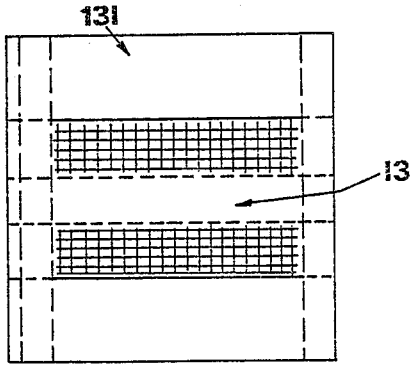
FIG 11A
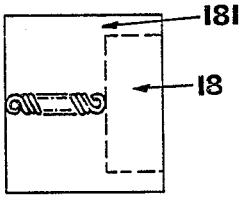
FIG 11B
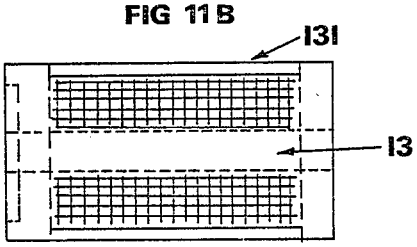

ELECTROMAGNETIC LOCK

The present invention relates to electromagnetic locks for example for doors and the like.

Hitherto electromagnetic locks for doors have normally been used to maintain a door in a predetermined position, for example, locked closed coplanar with a door frame or locked open against a wall (eg in the case of fire doors). The electromagnet is generally disposed with its axis horizontal and a magnetisable member mounted on the door is arranged so that as the door moves to its predetermined position the magnetisable member is moved axially into physical contact with the electromagnet. This has been considered necessary since it requires most force to move the magnetisable member away from the electromagnet along the axis of the electromagnet. Furthermore, it is only by arranging for physical contact of the magnetisable member and the electromagnet that sufficient force can be provided to maintain the door in the predetermined position with a reasonable size and cost of electromagnet.

These constraints have not allowed electromagnets to be used, for example, to lock in a closed position a double action door (ie a swing door) that is, to lock the doors in the plane of the frame, since the axially directed physical contact required prevents the door swinging to one side of the frame.

In one aspect, the present invention relates to an electromagnetic lock arrangement which may be applied to lock two members, such as a door and door frame and in particular to double action doors but the use of the electromagnetic lock is not restricted to that configuration; it can conveniently also be used with a normal single leaf single action door or elsewhere.

The present invention provides an electromagnetic lock for locking together two relatively movable members (such as a door and a door frame) in a predetermined relative position (such as the door closed), comprising electromagnet means and a magnetisable member, means to energise the electromagnet means to cause an electromagnetic field, and mounting means for mounting the electromagnet means and the magnetisable member, each to a respective one of the two relatively movable members in such a position that as the relatively movable members move to the predetermined position the magnetisable member and the electromagnet means move towards one another generally transversely of the axis of the electromagnetic field, and when the two relatively movable members are in said predetermined position said movable magnetisable member and/or said electromagnet means may move relatively towards one another generally along the axis of the electromagnetic field, under the action of the electromagnetic field, shoulder means being provided on or connected with said magnetisable member and said electromagnet means whereby when said relatively movable members are in said predetermined position and said movable magnetisable member and/or electromagnet means are moved axially towards one another said shoulders may engage to retain the two relatively movable members in said predetermined position even if the two relatively movable members are forced in such a manner to overcome the electromagnetic attraction between said magnetisable member and said electromagnet means.

In one configuration, the electromagnet is mounted to a door frame in a position to one side, above or below the door whereby the magnetisable member which is mounted on the door may swing past or up to the electromagnet generally transversely of the axis of the magnet.

The shoulder may be provided by a simple edge but may also be provided by other means such as teeth which engage in a slot with one another.

In a preferred arrangement the electromagnet is mounted adjacent the door and the door carries the magnetisable member although the configuration may be in the opposite sense, that is, the electromagnet carried by the door and the magnetisable member by the frame or adjacent surface. In normal circumstances, the magnetisable member will be movable towards the electromagnet, although it would be possible in some circumstances to arrange the electromagnet or components of the electromagnet to be movable towards the magnetisable member.

In a preferred arrangement the magnetisable member extends, when the two relatively movable members are in said predetermined position, to both sides of the electromagnet means and includes two shoulder means to prevent relative movement of the two relatively movable members in either direction. This arrangement is particularly useful in a swing door.

The shoulders should be relatively small so as to allow the electromagnetic field to attract the magnetisable member properly and in a preferred arrangement the shoulders of or connected with the electromagnet means and magnetisable member overlap, when engaged, to less than 10 mm and in a more preferred arrangement to approximately 4 mm.

The means for mounting the magnetisable member to its relatively movable member preferably comprises a pin which is adapted to pass through a slot in the relatively movable member.

The means to energise the electromagnet means includes a switch means which may be operable, for example, by a security component, such as a key, card or the like. The means to energise the electromagnet means preferably includes a proximity switch to provide an indication when the two relatively movable members are in said predetermined relative position. This prevents false locking if the electromagnet means is energised when the two relatively movable members are not in the predetermined relative position. The proximity switch preferably comprises a reed switch, one component of which is adapted to be mounted on one of said relatively movable members and the other component of which is adapted to be mounted on the other relatively movable member. Said proximity switch may be connected to a delay means whereby it will only indicate that the two relatively movable members are in said predetermined relative position after they have been in that position for a predetermined short period of time. This is particularly useful where the relatively movable members are provided by the swing door and door frame since it prevents the lock operating as the door swings quickly past the frame. The door must be stationary in line with the frame before the lock will operate.

In an important preferred arrangement there is provided a magnetic flux cancelling means for cancelling the magnetic flux in the electromagnet means when the electromagnet means is switched off. This is important since if any magnetic flux remains after the lock has been switched off it will remain engaged with the magnetisable member still attracted by the electromagnet means. The magnetic flux cancelling means preferably includes an electrical circuit for discharging the electromagnet means through itself and may also include delay means whereby when the electromagnet means is switched off, the discharge circuit is connected to the electromagnet means until the electromagnet means is discharged. The magnetic flux cancelling means may further include charge storage means whereby when the electromagnet means is discharged through itself, the charge from the charge storage means is applied to the electromagnet means to neutralise the residual magnetic flux. This is particularly important since it is almost impossible to discharge an electromagnetic coil to zero potential by short circuiting it and so the charge storage means which may be in the form of a capacitor provides just sufficient energy of correct polarity to neutralise the residual magnetism.

Preferred arrangements of the invention will now be described by way of example only and with reference to the accompanying drawings in which:

FIG. 1 shows, in block diagram form, an electric circuit diagram for controlling an electromagnetic lock according to the invention.

FIG. 2 shows in diagrammatic form the electromagnetic lock of the invention applied to a double action door, the lock being in an inoperative position, FIG. 3 shows the arrangement of FIG. 2 in an operative locked position, FIG. 4A shows a front view of a single action door with a lock according to the invention, FIG. 4B shows a vertical section of the door of FIG. 4A, and, FIGS. 4C and 4D show respectively side views and front views of the magnetisable member of the arrangement of FIGS. 4A and 4B, and, FIGS. 5A and 5B show views corresponding to FIGS. 4A and 4B of a double leaf double action doors incorporating locks according to the invention.

FIGS. 9A and 9B show perspective views of the two components of a further embodiment of electromagnetic lock according to the invention, FIGS. 10A and 10B show diagrammatic horizontal views of the components of FIGS. 9A and 9B;

Figure 5A:
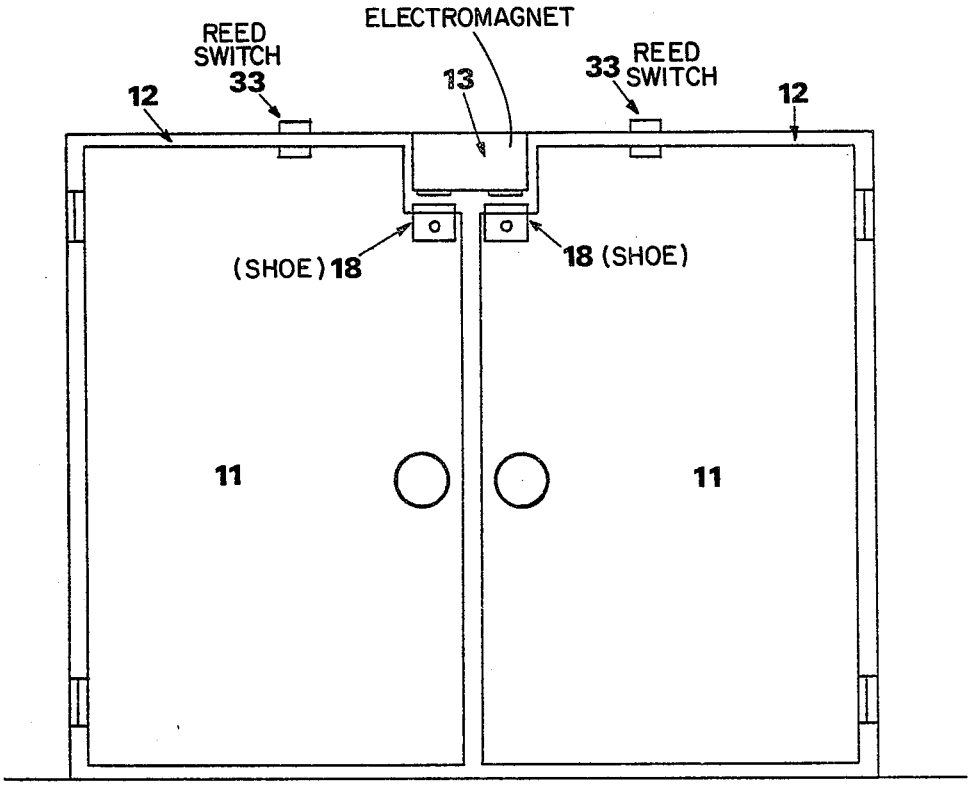

FIGS. 11A and 11B show diagrammatic vertical views of the components of FIGS. 9A and 9B, and, Referring to FIGS. 2 and 3, there is illustrated an electromagnetic lock assembly 10 for locking a door 11, the lock assembly 10 being mounted to a door frame 12. The lock assembly comprises, mounted to the door frame 12, an electromagnet 13 comprising a housing 14 and cores 16 which extend downwardly from the housing 14. The cores 16 are cylindrical in form with a vertical axis. Wires 17 to control the electromagnet 13 are illustrated.

To the top of the door 11 is mounted a magnetisable member in the form of a shoe 18 and as can be seen the shoe is mounted by means of two downwardly depending lugs 19 having a pin 21 extending therebetween, the pin 21 being mounted in a slot 20 through the door 11.

The upper surface of the shoe 18 includes upstanding end portions at its leading and trailing edge which provide shoulders 22, 23. The height of these shoulders is approximately 2 mm.

It will also be noted that the cores 16 extend downwardly from their housing 14 and their edges provide shoulders 24, 25.

The principle of operation of the apparatus is illustrated in FIGS. 2 and 3. The door is a double action door and if the electromagnets 13 are not energised when the shoe 18 is in the position shown in FIG. 2 and the door 11 may swing from side to side through the plane of the door frame 12. It will be noted that as the door 11 swings through the frame 12 the shoe 18 moves transversely to the axis of the electromagnets 13. When, however, it is desired to lock the door, and the door is in the predetermined position shown (ie in the plane of the frame 12), the electromagnets 13 are energised which attracts the shoe 18 upwardly along the axis of the electromagnetic field to the position shown in FIG. 3.

In this position the door is locked and cannot be moved. The basic force providing the locking is the electromagnetic attraction between the shoe 18 and the electromagnet 13. If, however, the door is forced such as to overcome the electromagnetic attraction (and it will be appreciated that since it can be overcome by a sliding horizontal movement at right angles to the axis of the electromagnet it requires less force than pulling the shoe downwardly away from the electromagnet) then the shoulders 22, 23, 24, 25 will cooperate to prevent movement of the door.

Since the electromagnet 13 pulls the shoe 18 up into physical contact and maintains it there the depths of the cooperating shoulders need not be very great. This is an important feature since the electromagnet 13 will not attract the shoe 18 with sufficient force over a very great distance if the shoulders had to be of great depth and therefore the shoe 18 had to be spaced by a greater distance from the electromagnet 13.

FIGS. 4, 5 and 6 show various dispositions of apparatus according to the invention for use with different types of doors. For example, in FIGS. 4A and 4B there is shown a lock assembly 10 for use with a single leaf single action door. In this case the lock assembly may be used to maintain the door in a closed position and is mounted at the top of the door frame. A configuration of shoe and a suitable mounting member 27 are shown in FIGS. 4C and 4D.

Figure 5B:
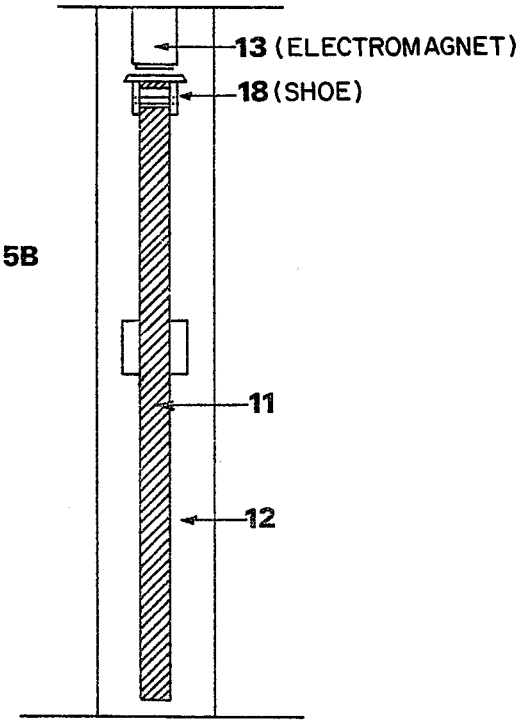
Figures 6A, 6B:
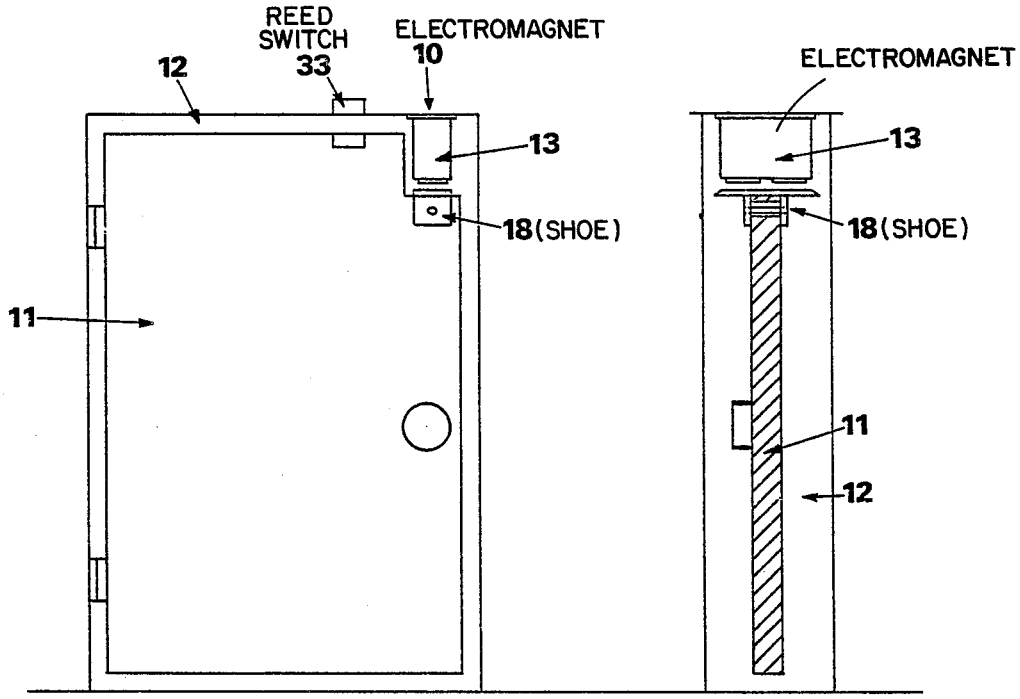
FIGS. 6A and 6B show views similar to FIGS. 4A and 4B of a single leaf double action door with a lock according to the invention.

FIGS. 5A and 5B show views corresponding to FIGS. 4A and 4B of a lock assembly 10 mounted to lock closed double leaf double action doors. FIGS. 6A and 6B show views corresponding to FIGS. 4A and 4B of a lock assembly 10 for locking closed a single leaf double action door.

The invention may be used in other configurations. For example, the electromagnet may be arranged to one side of the door or even below the door, for example, buried in the floor. In the last case, the shoe would be spring loaded upwardly. Furthermore, a similar lock assembly may be utilised to maintain a fire door in an open position which may be released when a fire warning is given and similarly the lock assembly may also be used in other conventional circumstances in which other types of lock are used.

FIG. 1 shows a schematic circuit diagram for a circuit to operate the electromagnet. The electromagnet is operated by means of a key switch or digital key pad 30 which supplies power to a switch circuit 31. There is provided a reed switch 32 adjacent the door and frame which closes whenever the door is in the correct position for locking (in the case of a double action door where the lock is to lock the door closed when the door is in the plane of the frame) which provides a signal to a door positioner and velocity sensor 32. The circuit is arranged so that the lock assembly 10 will only be energised when the switch 30 is closed and when the reed switch 33 has been closed for a predetermined length of time, in other words, when the door is stationary in the predetermined position rather than swinging past the predetermined position. When the switch 30 is opened, the electromagnet 13 no longer attracts the shoe 18 and the shoe 18 drops under gravity to the position in FIG. 2.

One of the problems with the use of electromagnets is that when they are switched off there is created a large back emf and means must be found to discharge this emf and to restore the magnet to an unmagnetised state, otherwise the shoe 18 may not be released.

There will now be described a circuit which, among other advantages, meets these requirements.

Figure 7:
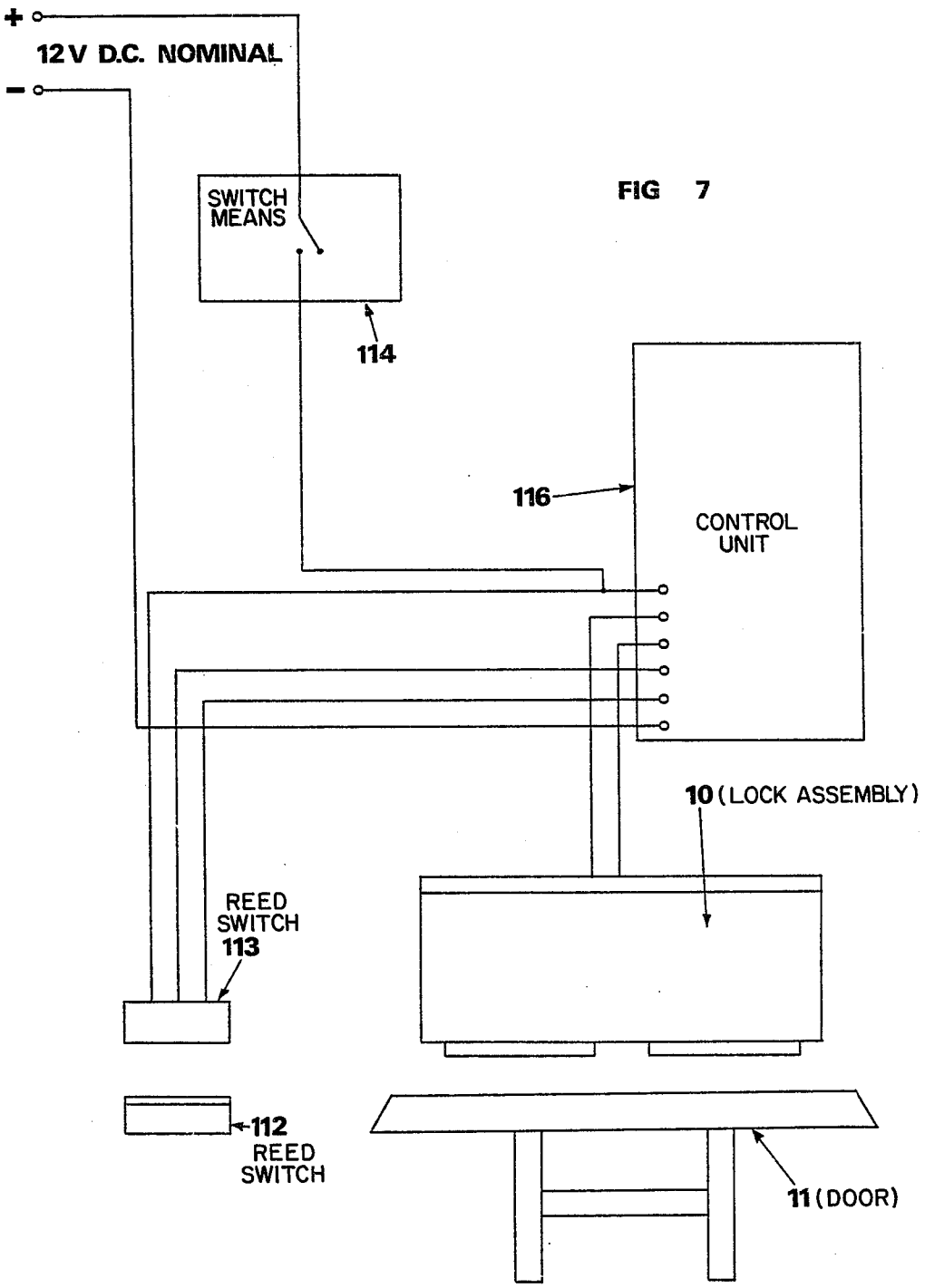
FIG. 7 is a diagram of a control circuit for controlling an electromagnetically locked door.

FIG. 7 is similar to FIG. 1, a switch means 114 corresponding to switch 30, a reed switch 112, 113 corresponding to reed switch 33, and control unit 116 corresponding to switch circuit 31 and sensor 32.

Figure 8:
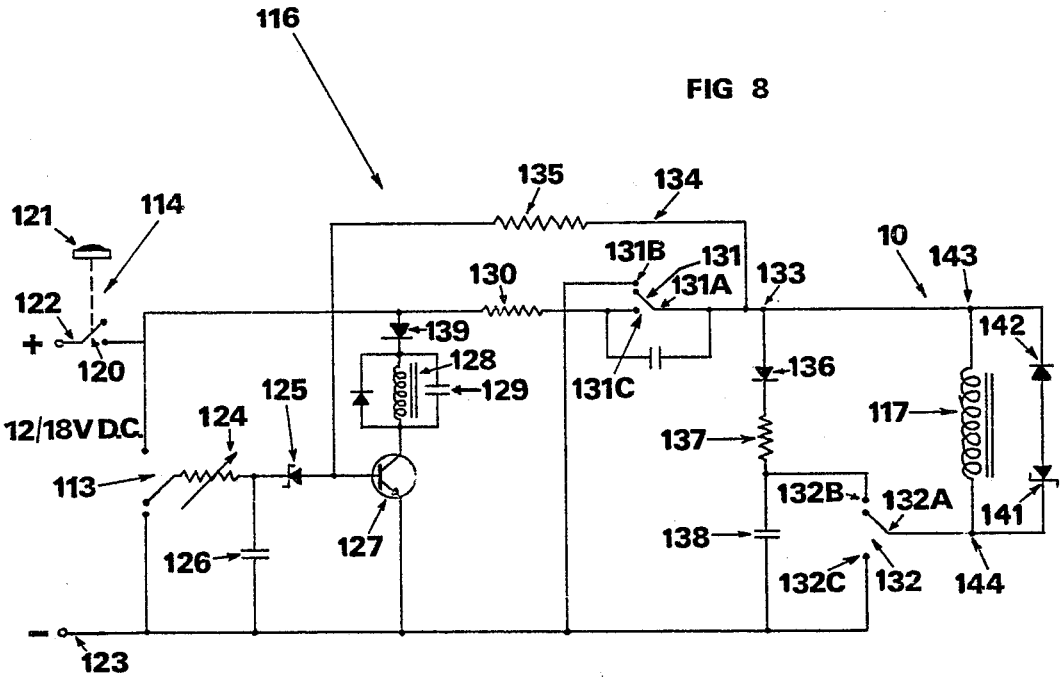
FIG. 8 is a detailed circuit diagram of the control circuit of FIG. 7.

FIG. 8 shows the various components of the circuit, the components being drawn in standard form. The circuit of FIG. 8 includes the control unit 116, the switch means 114, a coil 117 of the electromagnet 13 and the reed switch 113.

The circuit shown in FIG. 8 is in its unlocked state ie the electromagnetic lock 13 is unlocked. When it is wished to lock the door closed then a switch 120 of switch means 114 is closed by means of a key 121, key pad or the like so that both a positive power line 122 and negative power line 123 are connected to the circuit. The reed switch 113 is normally in the first state shown in FIG. 8 unless the door is in its closed position when the switch 113 moves to its second state. The next time after the switch 120 has been closed that the switch 113 moves to its second state, that is, the next time that the door closes, power is provided from the line 122 through the switch 120 and switch 113, through a variable resistor 124 to a zener diode 125 and to a capacitor 126. The zener diode 125 will not conduct until the capacitor 126 has charged up sufficiently to provide a sufficient potential and this provides a time delay so that if the door is a swing door and the door is closed (ie aligned with the frame) only temporarily the switch 113 will only remain in its second state for a short time and there will not be sufficient time for the capacitor 126 to charge up. The remainder of the circuit therefore would not operate so that the lock will not engage. This prevents false engagement of the lock when the door is not properly aligned with the frame. Any charge which does reach the capacitor 126 will be discharged when the switch moves back to the position shown in FIG. 8, ie when the door is opened.

If however the door is aligned with the frame and the reed switch 113 remains in its second state for a sufficient time for the capacitor 126 to charge sufficiently to allow the potential on the zener diode 125 to rise and thereby conduct, the potential from the power line 122 (less the zener voltage of zener diode 125) is then applied to the base of a transistor 127. This causes the transistor 127 to conduct which allows current to pass through the coil 128 of a relay. Therelay 128 which is in parallel with a capacitor 129 switches the switches 131 and 132 from the first states shown in FIG. 8 to their opposite states, so that in the case of switch 131 the contact 131A is connected to contact 131C rather than to 131B as in FIG. 8, and in the case of switch 132 contact 132A is connected to contact 132C rather than 132B as in FIG. 8. Power from the power line 122 then passes through resistor 130 and switch 131 to a point 133. The voltage is then applied from point 133 along line 134 via resistor 135 to the base of the transistor 127 thereby maintaining the transistor 127 in its conducting state. Furthermore the positive potential from point 133 passes through coil 117 of the electromagnet 13 and to the negative line via the switch 132. This energises the electromagnet which locks the door (or carries out whatever other function the electromagnet is intended to carry out). The voltage from point 133 also passes through a diode 136 and resistor 137 to charge a capacitor 138. In this way, so long as the power supply is maintained the current passes through the coil 117 to energise the electromagnet 13 and the door remains locked closed.

When it is desired to unlock the door, the key 121 is used to unlock the switch means 114 whereby the switch 120 is opened. This cuts off the supply from line 122.

The coil 117 is in parallel with two circuits, one including a forwardly biased diode 136, a resistor 137, and a capacitor 138, and the other including a rearwardly biased diode 142 and a zener diode 141.

When the power is switched off initially, because of the effect of the magnetic field produced by the coil 117, the potential at point 143 will rapidly drop to zero and will then pass to a high negative value and similarly the potential point at 144 will rise to a high positive value. When the value of the potential at 144 rises above 15 V (which is the zener voltage for the zener diode 141) current will pass through the coil, through the zener diode 141 and through the diode 142 and the current will continue to pass round that circuit until it dies away owing to the natural resistance of the coil 117.

This of course happens quite rapidly and at some stage the voltage at point 144 falls below the 15 volts zener voltage of the zener diode 141 and the zener diode 141 then stops conducting.

It should also be understood that after the switch 120 has been opened the potential across the circuit comprising diode 139, coil 128, capacitor 129 and transistor 127 is removed but because the capacitor 129 has been charged whilst the switch 120 is closed, it will maintain a current flow through the coil 128 because the transistor 127 is switched off and the diode 139 does not allow the current to be dissipated in other parts of the circuit. Thus the charge in capacitor 129 discharges through coil 128 maintaining the switches 131 and 132 in the same position as when the switch 120 was closed for a short period of time which is sufficient to allow the above described discharge of the coil 117 to take place.

However, after a time, the current through coil 128 is insufficient to maintain the switches 131 and 132 in that position and they switch over to the position shown in FIG. 8. This further allows the final discharge of the potential on the coil 117 since the capacitor 138 will have been charged whilst the switch 120 is closed and it is arranged that the charge from the capacitor 138 will be just sufficient to neutralise the potential across the coil 117 after the switch 132 has changed to the position shown in FIG. 8. The circuit is then returned to the state shown in FIG. 8 with the coil 117 having a zero potential at each end. It is essential of course to remove the residual magnetism in the coil 117 completely since it otherwise might retain the door locked closed which would be undesirable.

The circuit having returned to the state shown in FIG. 8 is now ready to be operated again to lock the door as desired and as described previously.

A further configuration of electromagnetic lock is shown in FIGS. 9 to 11. In this case the lock is particularly adapted for a single leaf single acting door and is also conveniently arranged to one side of the door rather than at the top. In this case, the shoe 18 is mounted in a first housing 181 in such a manner as to be able to move horizontally, springs 182 being adapted to retract the shoe 18 so as to be flush with the housing 181. The shoe 18 has a rectangular section.

The electromagnet 13 is mounted in a housing 131, the electromagnet 13 being arranged with its axis horizontal. The housing 131 includes two shoulders 241, 251 which are spaced apart a distance a little larger than the width of the shoe 18.

In use, when the door is closed and in the plane of the frame, the electromagnet 13 may be energised which will attract the shoe 18 into engagement with the electromagnet 13 or its housing 131 and opposite edges of the shoe 18 which provide corresponding shoulders 22, 23 will engage the shoulders 241, 251.

Although a preferred example of the circuit has been described to control an electromagnetic lock for a door it also has use in the control of electromagnetic devices in for example railway points, braking systems and the like.

I claim:

1. An electromagnetic lock for locking together two relatively movable members in a predetermined relative position, comprising:

electromagnet means, a magnetisable member, means to energise the electromagnet means to cause an electromagnetic field, magnetic flux cancelling means for cancelling the magnetic flux in the electromagnet means when the electromagnet means is switched off, said flux cancelling means including a circuit including charge storage means connected so that, when the electromagnet is switched off, the electromagnet discharges through itself and then charge from the charge storage means is applied to the electromagnet means to neutralise the residual magnetic flux, and mounting means for mounting the electromagnet means and magnetisable member each to a respective one of two relatively movable members in such a position that, as the relatively movable members move to the predetermined position, the magnetisable member and the electromagnet means move towards one another generally transversely of the axis of the electromagnetic field, whereby, when the two relatively movable members are in said predetermined position, said movable magnetisable member may move towards said electromagnet means generally along the axis of the electromagnetic field under the action of the electromagnetic field to normally hold said two relatively movable members in said predetermined relative position, shoulder means being provided on or connected with said magnetisable member and said electromagnet means whereby when said relatively movable members are in said predetermined position and said movable magnetisable member and electromagnet means are moved relatively axially towards one another said shoulders may engage to retain the two relatively movable members in said predetermined position even if the two relatively movable members are forced in such a manner to overcome the electromagnetic attraction between said magnetisable member and said electromagnet means.

2. An electromagnetic lock as claimed in claim 1 in which the magnetisable member extends, when the two relatively movable members are in said predetermined position, to both sides of the electromagnet means and includes two shoulder means to prevent relative movement of the two relatively movable members in either direction.

3. An electromagnetic lock as claimed in claim 1 in which the shoulders of or connected with the electromagnet means and the magnetisable member overlap, when engaged, to less than 10 mm.

4. An electromagnetic lock as claimed in claim 1 or 3 in which the shoulders of the electromagnet means and the magnetisable member overlap, when engaged, to approximately 4 mm.

5. An electromagnetic lock as claimed in claim 1 in which the means for mounting the magnetisable member to its relatively movable member comprise a pin adapted to pass through a slot in the relatively movable member.

6. An electromagnetic lock as claimed in claim 1 in which the means to energise the electromagnet means includes a switch means operable by a key, card or the like.

7. An electromagnetic lock as claimed in claim 1 in which the means to energise the electromagnet means includes a proximity switch to provide an indication when the two relatively movable members are in said predetermined position.

8. An electromagnetic lock as claimed in claim 7 in which said proximity switch comprises a reed switch, one component of which is adapted to be mounted on one of said relatively movable members and the other component of which is adapted to be mounted on the other relatively movable member.

9. An electromagnetic lock as claimed in claims 7 or 8 in which said proximity switch is connected to a delay means whereby it will only indicate that the two relatively movable members are in said predetermined relative position after they have been in that position for a predetermined short period of time.

* * * * *